US009928956B2

(12) United States Patent
Kitahara

(10) Patent No.: US 9,928,956 B2
(45) Date of Patent: Mar. 27, 2018

(54) PERMANENT MAGNET AND MANUFACTURING METHOD THEREFOR

(71) Applicant: Makoto Kitahara, Toyota (JP)

(72) Inventor: Makoto Kitahara, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 799 days.

(21) Appl. No.: 13/928,990

(22) Filed: Jun. 27, 2013

(65) Prior Publication Data

US 2014/0007980 A1 Jan. 9, 2014

(30) Foreign Application Priority Data

Jul. 9, 2012 (JP) ..... 2012-153196

(51) Int. Cl.

| | |
|---|---|
| ***H01F 1/03*** | (2006.01) |
| ***H01F 41/02*** | (2006.01) |
| ***H01F 7/02*** | (2006.01) |
| *H01F 1/057* | (2006.01) |

(52) U.S. Cl.

CPC ..... *H01F 41/0293* (2013.01); *H01F 7/02* (2013.01); *H01F 41/0253* (2013.01); *H01F 1/0577* (2013.01)

(58) Field of Classification Search

CPC ..... H01F 41/0293; H01F 1/0577; H01F 41/0253; H01F 7/02

See application file for complete search history.

(56) References Cited

U.S. PATENT DOCUMENTS

2007/0017601 A1 1/2007 Miyata et al.
2010/0244608 A1* 9/2010 Nakamura ..... H01F 1/08 310/156.38
2011/0080066 A1* 4/2011 Doi ..... H02K 1/276 310/156.43
2011/0250087 A1 10/2011 Sagawa (Continued)

FOREIGN PATENT DOCUMENTS

CN 101110289 A 1/2008
CN 101889318 A 11/2010
CN 102209999 A 10/2011

(Continued)

OTHER PUBLICATIONS

Machine translation of JP 2011229329 A. Nov. 2011.*

(Continued)

*Primary Examiner* — Xiaowei Su
(74) *Attorney, Agent, or Firm* — Oliff PLC

(57) ABSTRACT

In permanent magnets formed by division, a cut-out part is provided in a straight line in the matrix of the permanent magnets, a metal increasing the coercive force the permanent magnet matrix is diffused into the interior of the matrix from a surface that includes the surface of the cut-out part of the permanent magnet matrix, and the permanent magnet matrix is divided into multiple permanent magnet parts along the straight cut-out part to form the permanent magnets. An Nd—Fe—B sintered magnet may be used as the permanent magnet matrix, and dysprosium (Dy) may be used as the metal increasing the coercive force of the permanent magnet. Multiple indentations disposed in a straight line may be used as the cut-out parts, or a straight groove may also be used.

6 Claims, 4 Drawing Sheets

(56) References Cited

U.S. PATENT DOCUMENTS

2012/0176211 A1* 7/2012 Sagawa ..... C22C 38/001
335/302

FOREIGN PATENT DOCUMENTS

| | | | | | |
|---|---|---|---|---|---|
| JP | A-2009-142081 | | | 6/2009 | |
| JP | A-2010-110110 | | | 5/2010 | |
| JP | A-2010-259231 | | | 11/2010 | |
| JP | A-2011-108776 | | | 6/2011 | |
| JP | 2011229329 | A | * | 11/2011 | |
| JP | A-2012-39100 | | | 2/2012 | |
| JP | A-2012-43968 | | | 3/2012 | |
| WO | WO 2010/052862 | A1 | | 5/2010 | |
| WO | WO 2011004894 | A1 | * | 1/2011 | ..... C22C 38/001 |
| WO | WO 2012/007828 | A1 | | 1/2012 | |

OTHER PUBLICATIONS

Shevchenko, Applied Physics Letters, 1999, vol. 74, p. 1478-1480.*
Bai, Journal of Magnetism and Magnetic Materials, 2007, vol. 308, p. 20-23.*

* cited by examiner

PERMANENT MAGNET AND MANUFACTURING METHOD THEREFOR

INCORPORATION BY REFERENCE

The disclosure of Japanese Patent Application No. 2012-153196 filed on Jul. 9, 2012 including the specification, drawings and abstract is incorporated herein by reference in its entirety.

BACKGROUND OF THE INVENTION

1. Field of the Invention

The invention relates to a permanent magnet and a method of manufacturing the permanent magnet, and relates in particular to a permanent magnet having a metal with high coercive force diffused in the interior thereof, and to a method of manufacturing the permanent magnet.

2. Description of Related Art

Coercivity (Hc) and remanence (Br) are used as measures of the performance of permanent magnets. Coercivity is defined as the intensity of a reverse external magnetic field required to return a magnetized body to an unmagnetized state. Remanence is the magnetization that remains when the external magnetic field is zero.

When a permanent magnet is disposed on the rotor of a rotating electrical machine, it is affected by the magnetic field from the stator. That is, if the direction of the magnetic field from the stator is the reverse of the magnetization direction of the permanent magnet, the permanent magnet undergoes demagnetization in case its coercivity is small. To increase the coercivity of the surface of a permanent magnet when exposed to an external magnetic field, a metal with high coercive force is diffused from the surface towards the interior of the permanent magnet.

For example, Japanese Patent Application Publication No. 2012-39100 (JP 2012-39100 A) discloses a manufacturing method whereby the coercive force of a permanent magnet is improved. Namely, highly coercive dysprosium (Dy) or terbium (Tb) is added by grain boundary diffusion to a neodymium (Nd)-iron (Fe)-boron (B) sintered magnet, substituting Dy or Tb for Nd.

Japanese Patent Application Publication No. 2011-108776 (JP 2011-108776 A) also discloses improving coercive force by grain-boundary diffusion. The metal grains of highly coercive Dy or Tb are diffused in an Nd—Fe—B sintered magnet. In this case, it is stated that the magnetic properties of the permanent magnet are actually reduced if Dy or the like completely permeates the interior of the permanent magnet. Therefore, it is considered better if diffusive permeation of the metal grains is limited to a depth in a range of about 10 μm or more to a few mm in the surface layer.

Japanese Patent Application Publication No. 2012-43968 (JP 2012-43968 A) also discloses improving coercive force by grain-boundary diffusion. The metal grains of highly coercive Dy or Tb are diffused in an Nd—Fe—B sintered magnet. In this case, yttrium (Y), which has a smaller oxide generation energy than either Nd or Dy, is included in the magnet before diffusion. It is said that this causes deeper diffusion of Dy in the interior of the sintered body.

Japanese Patent Application Publication No. 2010-259231 (JP 2010-259231 A) discloses dividing a permanent magnet for a magnetic field pole into multiple magnet pieces, although the dividing direction of the magnet is different from that of this invention. In this case, the matrix of a permanent magnet for a magnetic field pole is made as a rectangular bar, and divided into multiple magnet pieces in the longer direction so as to control heat generation caused by eddy current in a permanent magnet for a magnetic field. The multiple magnet pieces are separated by insulating members between them, and connected so as to obtain the same shape as the original permanent magnet.

According to these documents, the surface coercivity of a permanent magnet can be increased by diffusing a highly coercive metal from the surface towards the interior of the permanent magnet. As discussed in JP 2011-108776 A, diffusion of the highly coercive metal is limited to a certain depth. Therefore, if a permanent magnet with increased surface coercivity is divided into multiple magnet parts as described in JP 2010-259231 A, part of the interior of the permanent magnet matrix, which lacks the diffused highly coercive metal, is exposed on the division surface. Demagnetization may occur when an exposed surface without increased coercivity is exposed to a strong alternating field.

SUMMARY OF THE INVENTION

The invention relates to a permanent magnet that is resistant to demagnetization even when formed by dividing a permanent magnet matrix into multiple parts, and to a manufacturing method therefor.

The first aspect of the invention is a permanent magnet formed by diffusing a metal having a higher coercive force than a matrix of the permanent magnet in the interior of the matrix and dividing the matrix into multiple parts, this permanent magnet including a cut-out part for diffusing the metal having a higher coercive force in the interior of the matrix, with the matrix being divided into multiple parts at the cut-out part.

In this permanent magnet, the cut-out part may also consist of multiple indentations disposed in a straight line.

In this permanent magnet, the cut-out part may also be a straight groove.

In this permanent magnet, the matrix of the permanent magnet is divided into two permanent magnets, and the two permanent magnets fainted by this division may be a pair of permanent magnets forming respective multiple field systems of a rotating electrical machine.

In this permanent magnet, cut-out depth of the cut-out part may be equal to or greater than the {(width (W) of the division direction in the matrix)/2−(diffusion depth of highly coercive metal)}.

The second aspect of the invention is a permanent magnet provided with a division surface where a metal having a higher coercive force than the matrix of the permanent magnet is diffused from the surface into the interior of the permanent magnet.

The third aspect of the invention is a method of manufacturing a permanent magnet, including providing a cut-out part in a straight line on the matrix of the permanent magnet, diffusing a metal with a higher coercive force than the matrix into the interior of the matrix from a surface that includes the surface of the cut-out part of the matrix, and dividing the matrix into multiple permanent magnets along the cut-out part.

With at least one of these configurations, a cut-out part is provided for diffusing a metal with a higher coercive force than a matrix into the interior of the matrix, and permanent magnets are formed by dividing the matrix into multiple parts at the cut-out part. Because the highly coercive metal can be diffused to a specific depth from the surface of the cut-out part, the highly coercive metal can be diffused more deeply (by the depth of the cut-out part) at the division surface of the divided matrix than without a cut-out part. Thus, even if the division surface is exposed to an alternating magnetic field, demagnetization is less likely than without the cut-out part.

Moreover, the cut-out part can be formed easily when it consists of multiple indentations disposed in a straight line. Moreover, the cut-out part can also be formed easily when it is a straight groove.

Moreover, the permanent magnet matrix is divided into two permanent magnets, and the two permanent magnets are used as a pair of permanent magnets forming the respective multiple field systems of a rotating electrical machine. Demagnetization is less likely with each of this pair of permanent magnets than without the cut-out part even when the magnets are exposed to an external alternating magnetic field. This makes it possible to maintain adequate performance of the rotating electrical machine in the long term.

With at least one of these configurations, moreover, a cut-out part is provided in a straight line on a permanent magnet matrix, a metal with a higher coercive force than the matrix is diffused into the interior of the matrix from a surface that includes the surface of the cut-out part of the permanent magnet matrix, and the permanent matrix magnet is divided into multiple permanent magnets along the straight cut-out part. Thus, the process of manufacturing the permanent magnet can be simplified because the cut-out part functions both as a trench for introducing and diffusing the metal with a higher coercive force, and as a notch for purposes of division.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
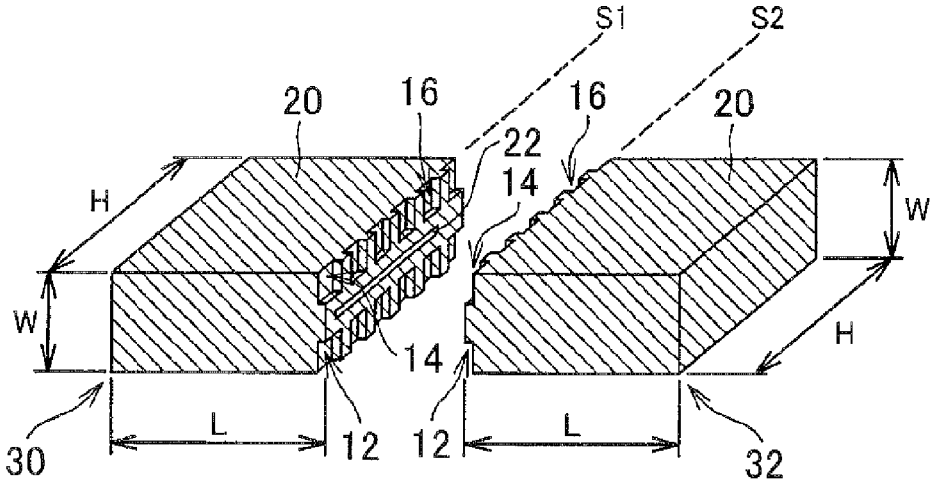
FIG. 1 is a drawing showing permanent magnets formed by dividing a permanent magnet matrix in two parts in an embodiment of the invention.

Embodiments of the invention are explained in detail below using the drawings. The matrix of the permanent magnet has a cuboid shape in the explanations below, but other shapes are possible. For example, a permanent magnet matrix having a flat plate shape having a circular arc, a bar shape having a circular cross-section or oval cross-section or the like, or another pre-determined solid shape is also possible. Moreover, although a single permanent magnet matrix is described below as being divided into two permanent magnets, this is only an example for purposes of explanation, and the number of permanent magnets obtained by dividing a single permanent magnet matrix may also be three or more.

Although the matrix of the permanent magnet is a Nd—Fe—B rare earth magnet in the explanations below, another rare earth magnet such as a samarium-cobalt magnet, samarium-Fe-nitrogen magnet or the like is also possible. In addition to rare earth magnets, a ferrite magnet or alnico magnet is also possible. Although Dy is described as the metal having a higher coercive force than the matrix of the permanent magnet, Tb is also possible.

In the drawings, like reference numerals designate like elements throughout the different views, and redundant explanations are omitted.

FIG. 1 is a drawing showing permanent magnets 30, 32 formed by dividing a permanent magnet matrix into two parts. The division surfaces where the permanent magnet matrix is divided into the two permanent magnets 30, 32 are a surface S1 of the permanent magnet 30 and a surface S2 of the permanent magnet 32. Permanent magnets 30, 32 each have the dimensions L×W×H (see FIG. 1). Thus, the permanent magnet matrix before division has the dimensions 2L×W×H.

The permanent magnets 30, 32 of this embodiment have a Nd—Fe—B rare earth sintered magnet as a matrix, with Dy diffused in advance from the surface to a specific depth thereof. This permanent magnet matrix is a sintered magnet of Fe with Nd and B added thereto, and trace amounts of elements other than Nd and B may also be added. Dy is a metal having a higher coercive force than that of the Nd—Fe—B magnet. The coercivity of the surfaces of the permanent magnets 30, 32 can be elevated above the coercivity of the interiors by diffusing the Dy from the surface. In FIG. 1, a part 20 having diffused Dy is shown with diagonal shading. The diffusion depth of Dy can be determined by the specifications of the permanent magnets 30, 32. For example, the diffusion depth is set at an appropriate value between a few μm and a few mm. The diffusion depth of Dy is set to a value that is sufficiently smaller than all of the L, W and H.

Thus, the permanent magnets 30, 32 are formed by splitting a permanent magnet matrix into two parts. The permanent magnet matrix is an Nd—Fe—B rare earth sintered magnet having Dy diffused from the surface towards the interior. Dy is a metal with a higher coercive force than the permanent magnet matrix. In case the permanent magnet matrix in a cuboid shape is simply divided into two after the diffusion of Dy, for example, a surface without the diffused Dy is exposed on the division surfaces because the diffusion depth of Dy is sufficiently smaller than the dimension W.

In the invention, the matrix of the permanent magnet is provided with multiple indentations (in other words, concave portions) 12, 14 and 16 disposed in a straight line as cut-out parts. Dy diffuses from the surfaces of these cut-out parts into the interior of the permanent magnet. In this embodiment, these indentations (cut-out parts) 12, 14 and 16 are provided just in the center of the length 2L of the permanent magnet matrix. The permanent magnet matrix is then divided into two at these indentations (cut-out parts) 12, 14 and 16.

Thus, permanent magnets 30, 32 have a cut-out part provided for diffusing the highly coercive metal Dy into the interior. The permanent magnets 30, 32 are formed by dividing into multiple parts at this cut-out part. That is, the indentations 12, 14 and 16 function as trenches for diffusing Dy into the interior, and also as cut-out parts that facilitate the division of the permanent magnet matrix into two parts.

When the permanent magnet matrix is divided into two parts at these indentations 12, 14 and 16, a surface 22 having no diffused Dy may appear at the surface S1 and surface S2 (the division surfaces of the divided permanent magnets 30 and 32). The dimension of width in the direction W of this surface 22 having no diffused Dy is roughly [W−{(depth of indentations 12, 14, 16)+(diffusion depth of Dy)}×2]. Thus, the dimension of width in the direction W of the surface 22 having no diffused Dy on the division surface can be made desirably small by setting the depth of indentations 12, 14, 16 appropriately. For example, by making the depth of the indentations 12, 14, 16 equal to or greater than [W/2−(diffusion depth of Dy)], it is possible to ensure that the surface 22 having no diffused Dy does not appear at the division surfaces.

Figure 2:
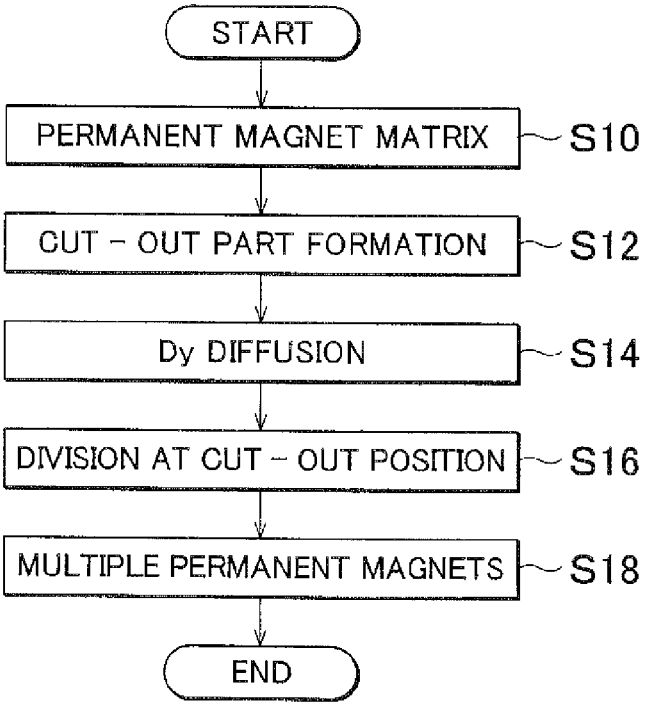
FIG. 2 is a flow chart showing the procedures of a method of manufacturing a permanent magnet in an embodiment of the invention.

Next, the method of manufacturing the permanent magnets 30, 32 of this embodiment is explained using FIGS. 2 to 6. FIG. 2 is a flow chart showing the procedures of the method of manufacturing the permanent magnets 30, 32, and FIGS. 3 to 6 illustrate each procedure in detail.

Figure 3:
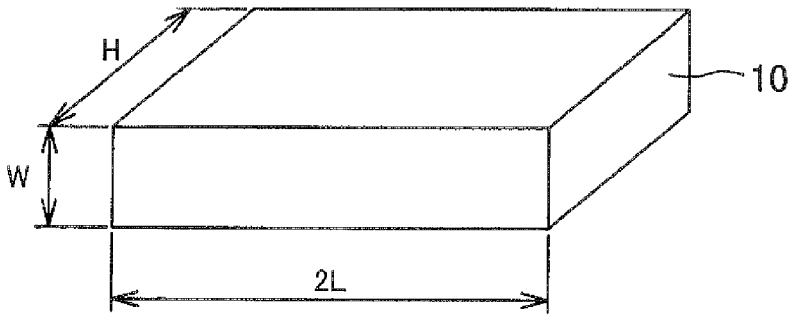
FIG. 3 shows a permanent magnet matrix prepared by the procedures of FIG. 2.

The first step is a step (S10) of preparing the matrix 10 of the permanent magnet. The permanent magnet matrix 10 is ultimately divided into the two permanent magnets 30, 32. Before being divided, the permanent magnet matrix 10 is a single permanent magnet. As shown in FIG. 3, the permanent magnet matrix 10 has a cuboid shape with dimensions 2L×W×H. The permanent magnet matrix 10 is an $Nd_2Fe_{14}B$ rare earth sintered magnet. In one example of a composition given in mass percentages, it contains 25% Nd, 1% B, 3.1% Pr, 1% Co, 0.1% S11, 0.1% Cu and 0.1% O, with the remainder being Fe.

Figure 4:
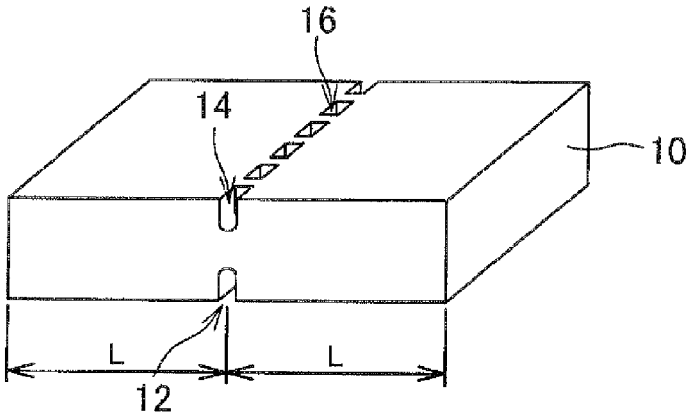
FIG. 4 is a drawing showing a permanent magnet matrix formed with a cut-out part by the procedures of FIG. 2.

The next step is a step (S12) of forming a cut-out part on both the front and back surface of the permanent magnet matrix 10. The cut-out part consists of multiple indentations 12, 14 and 16 disposed in a straight line in the direction H. This straight line is disposed in the exact center of the length 2L of the matrix 10. As shown in FIG. 4, six indentations are formed on the front surface and six indentations are formed on the back surface of the permanent matrix 10 for example as the cut-out part. In FIG. 4, the symbols 12, 14 and 16 are assigned to three typical examples of these twelve indentations.

The indentations 12, 14 and 16 are trenches extending in the direction W. The depths of the indentations 12, 14 and 16 are set based on the following two considerations.

The first consideration is achieving a desirably small width dimension in the direction W of the surface 22 having no diffused Dy at the division surfaces when the permanent magnet matrix 10 is divided into two permanent magnets formed by division. Based on this consideration, the depths of the indentations 12, 14 and 16 are calculated based on the dimension value of W and the diffusion depth of Dy.

The spacing between adjacent indentations 12, 14 and 16 is preferably set to no more than two times the diffusion depth of Dy. In this way, Dy is diffused into the interior of the permanent magnet matrix 10 (Nd—Fe—B sintered magnet) between adjacent indentations from the surface of the indentations 12, 14 and 16, at least as far as the depth of the indentations 12, 14 and 16.

The second consideration is to facilitate division when the permanent magnet matrix 10 is divided into two permanent magnets. Based on this consideration, the depth of the indentations 12, 14 and 16 is calculated based on the physical values indicating the breakability of the permanent magnet matrix 10, and the value of the dimension W.

The depth of the indentations 12, 14 and 16 is then set to the larger of the values for the depth of indentations 12, 14 and 16 as calculated based on these two considerations.

The step after step S12 is a Dy diffusion step (S14). In this step S14, a metal with a higher coercive force than the permanent magnet matrix 10, Dy, is diffused from surface into the interior of the permanent magnet matrix 10. The surface where Dy is diffused includes the surfaces of the indentations 12, 14 and 16, which are cut-out parts of the permanent magnet matrix 10. A number of methods for diffusing Dy are described below.

One example of a diffusion method is described below. First, a thin film of Dy is formed by sputtering on the surface of the permanent magnet matrix 10. Then, heat treatment in a vacuum or inactive gas atmosphere is preformed. After the hear treatment, the matrix temperature is return to room temperature, and then perform heat treatment again. For example, after thin film formation the temperature is maintained for 10 hours at 800° C. to 900° C. under suitable reduced pressure, returned to room temperature, and then maintained for 1 hour at 500° C. In this way, Dy is diffused to a desired diffusion depth from the entire surface of the permanent magnet matrix 10 including the surfaces of the indentations 12, 14 and 16. These temperature conditions and retention times are only examples, and other conditions are possible.

Another diffusion method is to heat treat the vacuum glass-sealed permanent magnet matrix 10 together with Dy in a high temperature atmosphere, return the matrix to room temperature, and then perform heat treatment again. For example, the vacuum glass-sealed matrix can be maintained for 50 hours at 800° C. to 900° C., returned to room temperature, and then maintained for 1 hour at 500° C. In this way, Dy is diffused to a desired diffusion depth from the entire surface of the permanent magnet matrix 10 including the surfaces of the indentations 12, 14 and 16. These temperature conditions and retention times are only examples, and other conditions are possible.

Figure 5:
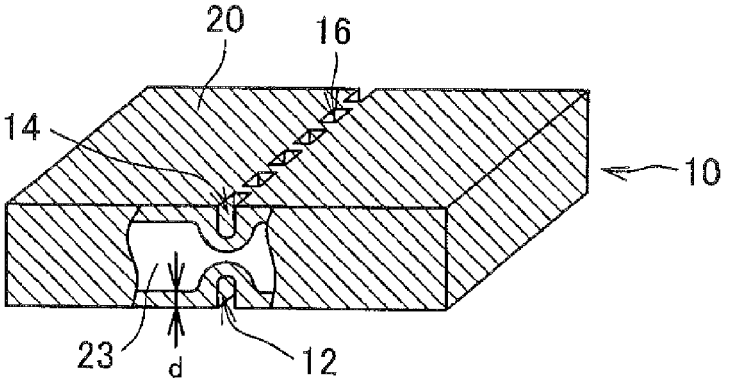
FIG. 5 uses a partial cross-sectional view to illustrate a permanent magnet matrix having a highly coercive metal diffused therein by the procedures of FIG. 2.

FIG. 5 shows a permanent magnet matrix 10 with diffused Dy. A partial cross-section is used here to show the diffusion depth d of Dy and the part 23 without diffused Dy. It can be seen that the part 23 without diffused Dy is narrower in the area with indentations 12, 14.

Returning to FIG. 2, the next step of the manufacturing method is explained. After step S14, step S16 of dividing the permanent magnet matrix 10 at the cut-out position is performed. When division is complete, two divided permanent magnets 30, 32 are obtained (S18). More generally, "multiple permanent magnets" are obtained by division as shown in FIG. 2. In this embodiment, the example of a permanent magnet divided into two parts is given. A permanent magnet divided into (N+1) parts can be obtained if the cut-out part is formed in N number of straight lines in step S12.

Figure 6A:
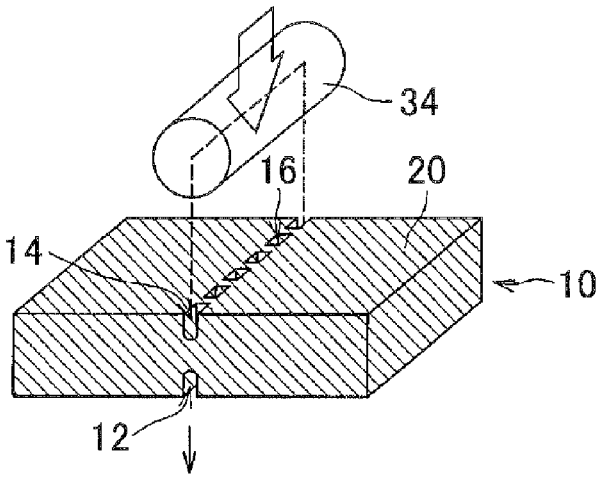
FIGS. 6A and 6B are drawings illustrating the step of using the cut-out part to divide the permanent magnet matrix into two parts according to the procedures of FIG. 2.
Figure 6B:
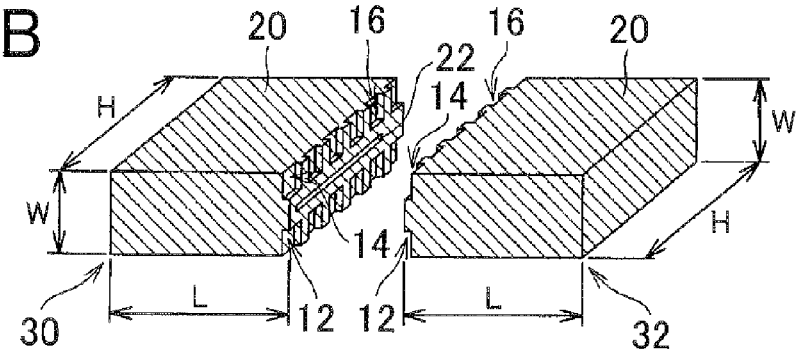

FIGS. 6A and 6B show the division of the matrix. FIG. 6A shows a breaker 34 being pressed down along the direction of the indentations 12, 14 and 16, which are cut-out parts on the front surface of the permanent magnet matrix 10 as shown in FIG. 5. Due to pressure exerted on the breaker 34, the indentations (cut-out parts) 12, 14 and 16 become base points for the division of the permanent magnet matrix 10. In FIG. 6A, division is triggered at the indentations on the opposite side from the surface being pressed by the breaker 34. Division occurs along a straight line that includes the indentations 12, 14 and 16. As a result, the matrix is divided into two permanent magnets 30, 32 as shown in FIG. 6B. FIG. 6B is the same drawing as FIG. 1.

Figure 7A:
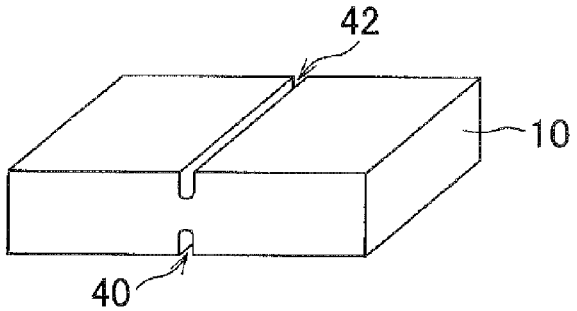
FIGS. 7A and 7B are drawings illustrating examples of other cut-out parts in an embodiment of the invention.
Figure 7B:
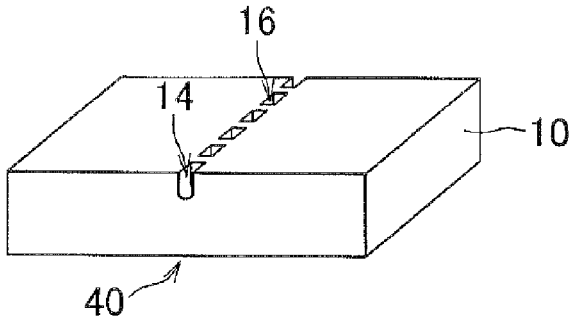

FIGS. 7A and 7B show other examples of the cut-out part formed in S12. In the example of FIG. 7A, grooves 40, 42 are formed in a straight line as the cut-out part. Grooves 40, 42 are formed on both the front and back surfaces of the permanent magnet matrix 10. The positions of grooves 40, 42 and the depths of the grooves are set in the same way as for indentations 12, 14 and 16 as explained in FIG. 4. Indentations 12, 14 and 16 in FIG. 4 and grooves 40, 42 in FIG. 7A are formed on both the front and the back surfaces of the permanent magnet matrix 10. However, a cut-out part may also be formed on either one of the front and back surfaces. FIG. 7B shows an example in which indentations 14, 16 are formed only on the front surface of the permanent magnet matrix 10, and not on the back surface 44.

Figure 8A:
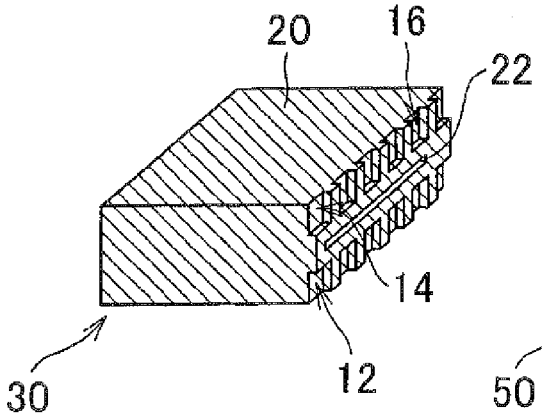
FIGS. 8A and 8B are drawings illustrating a permanent magnet of an embodiment of the invention in comparison with an example having no cut-out part.
Figure 8B:
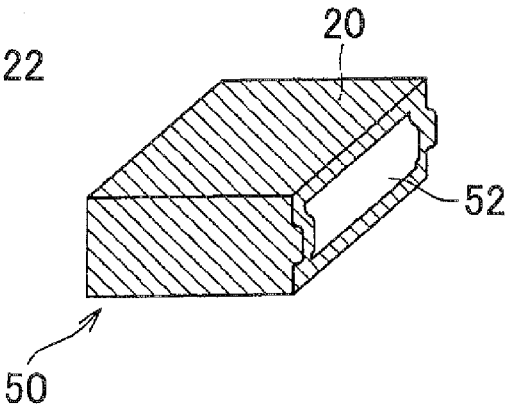

FIGS. 8A and 8B illustrate the difference resulting from the presence or absence of the cut-out part. FIG. 8A shows the permanent magnet 30 explained in FIG. 1. In this case, indentations 12, 14 and 16 are formed as cut-out parts. The dimension of width in the direction W of surface 22 having no dispersed Dy on the division surface is [W−{(depth of indentations 12, 14, 16)+(diffusion depth of Dy)}×2]. FIG. 8B shows a permanent magnet 50 obtained by simply dividing a cuboid permanent magnet matrix 10 in two without any cut-out part. In this case, the dimension of width in the direction W of the surface 52 without diffused Dy on the division surface is [W−{(diffusion depth of Dy)}×2].

Thus, the direction of width in the direction W of the surface without diffused Dy on the division surface can be reduced by the {(depth of indentations 12, 14 and 16)×2} by providing the cut-out part. In this way, it is possible to greatly reduce or preferably eliminate the area on the division surface that does not have increased coercivity.

Figure 9:
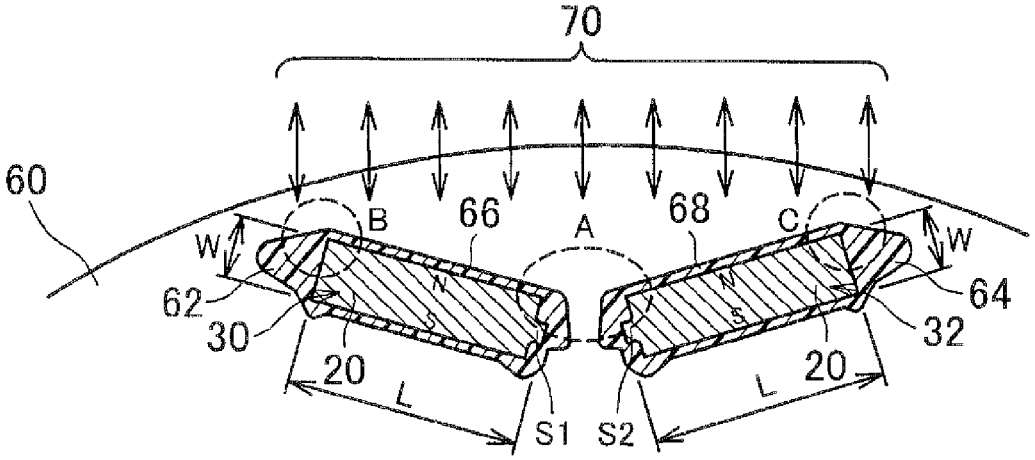
FIG. 9 is a drawing illustrating an example of a permanent magnet of an embodiment of the invention used as a magnet for a magnetic field in the rotor of a rotating electrical machine.

FIG. 9 illustrates an example using permanent magnets 30, 32 as magnets for the magnetic field of the rotor 60 of a rotating electrical machine. FIG. 9 shows a pair of magnet slots 62, 64 for installing a pair of magnets for a magnetic field on the rotor 60 in order to form a monopole field system on the rotor 60. These are inserted into the magnet slots 62, 64 so that the direction H of the permanent magnet 30 (see FIG. 1) matches the axial direction of the rotor 60 (direction perpendicular to paper surface). The gaps between magnet slots 62, 64 and permanent magnets 30, 32 are filled with resin 66, 68. Because the permanent magnets 30, 32 are obtained by dividing a single permanent magnet matrix 10, their magnetic characteristics are aligned. They can thus be used favorably as a pair of magnets for a magnetic field.

Because an alternating magnetic field 70 from the stator crosses the rotor 60, the permanent magnets 30, 32 are exposed to magnetization from this alternating magnetic field. If the coercivity of the permanent magnets 30, 32 is small, demagnetization may occur because the alternating magnetic field includes a reverse magnetic field in the opposite direction from the direction of magnetization of the permanent magnets. When demagnetization occurs, the torque of the rotating electrical machine is reduced. In this invention, Dy that is highly coercive can be diffused on roughly all surfaces including the division surfaces of the permanent magnets 30, 32, to thereby provide the permanent magnets 30, 32 capable of withstanding a reverse magnetic field.

In the permanent magnets 30, 32, the sites that are affected by the alternating magnetic field 70 from the stator are those shown by A, B and C in FIG. 9. Site A includes the division surfaces S1, S2. As explained with reference to FIG. 1, because the division surfaces S1 and S2 are provided with the indentations 12, 14 and 16 as cut-out parts, the surfaces 22 having no diffused Dy are small, and the desired high coercivity can be maintained. In this way, it is possible to control demagnetization of permanent magnets 30, 32, and maintain the torque characteristics of the rotating electrical machine.

In the explanations above, Dy is diffused from all surfaces of the permanent magnet matrix 10. Dy is a scarce and expensive resource, so if the coercivity of only certain sites of the permanent magnets 30, 32 needs to be increased, diffusion of Dy is preferably limited to those sites. For example, Dy may be diffused only in the areas surrounding the sites A, B and C in the example of FIG. 9.

The permanent magnet of the present invention can be used as a magnet for a magnetic field in a rotating electrical machine to be installed in a vehicle.

What is claimed is:

1. A permanent magnet formed by diffusing a metal that increases a coercive force of the permanent magnet into an interior of a matrix and dividing the matrix into multiple permanent magnets, the permanent magnet comprising:

a cut-out part or cut-out parts for diffusing the metal that increases the coercive force in the interior of the matrix, with the matrix being divided into multiple permanent magnets at the cut-out part or cut-out parts, and the metal increasing the coercive force is diffused on division surfaces of the permanent magnet, wherein a cut-out depth of the cut-out part or cut-out parts is equal to or greater than the {(width (W) of the permanent magnet along the division direction in the matrix/2−(a diffusion depth of the metal that increases the coercive force of the permanent magnet)}.

2. The permanent magnet according to claim 1, wherein the cut-out parts are multiple indentations disposed in a straight line before the matrix is divided into multiple permanent magnets.

3. The permanent magnet according to claim 1, wherein the cut-out part or cut-out parts is a straight groove before the matrix is divided into multiple permanent magnets.

4. The permanent magnet according to claim 1, wherein the matrix of the permanent magnet is divided into two permanent magnets, and the two permanent magnets are a pair of permanent magnets forming one of multiple field systems of a rotating electrical machine.

5. The permanent magnet according to claim 1, wherein the metal increasing the coercive force is diffused on all surfaces, including the division surfaces of the permanent magnet.

6. A method of manufacturing the permanent magnet according to claim 1, the method comprising:

providing a cut-out part or cut-out parts in a straight line in the matrix of the permanent magnet;

diffusing a metal that increases a coercive force of the permanent magnet into the interior of the matrix from a surface that includes the surface of the cut-out part or cut-out parts of the matrix; and dividing the permanent magnet matrix into multiple permanent magnets at the cut-out part or cut-out parts, wherein the metal improving the coercive force is diffused on division surfaces of the permanent magnet.

* * * * *